US011446948B1

(12) United States Patent
Croix

(10) Patent No.: US 11,446,948 B1
(45) Date of Patent: Sep. 20, 2022

(54) BOOK WORKSTATION FOR PAIRED USERS

(71) Applicant: LaShanna J. Croix, Woodland Park, NJ (US)

(72) Inventor: LaShanna J. Croix, Woodland Park, NJ (US)

( * ) Notice: Subject to any disclaimer, the term of this patent is extended or adjusted under 35 U.S.C. 154(b) by 0 days.

(21) Appl. No.: 17/373,953

(22) Filed: Jul. 13, 2021

(51) Int. Cl.

| | |
|---|---|
| ***B42D 1/00*** | (2006.01) |
| ***B42F 3/06*** | (2006.01) |
| ***B43L 1/00*** | (2006.01) |
| ***B42D 1/06*** | (2006.01) |

(52) U.S. Cl.
CPC ..... *B42D 1/007* (2013.01); *B42D 1/001* (2013.01); *B42D 1/06* (2013.01); *B42F 3/06* (2013.01); *B43L 1/00* (2013.01); *B42P 2241/16* (2013.01)

(58) Field of Classification Search
CPC ..... B42D 1/001; B42D 1/007; B42F 3/06
USPC ..... 281/16, 39
See application file for complete search history.

(56) References Cited

U.S. PATENT DOCUMENTS

| | | | | | |
|---|---|---|---|---|---|
| 2,075,529 | A * | 3/1937 | Leubrie | G09B 11/06 | D19/27 |
| 3,492,743 | A * | 2/1970 | Schmidt | G09B 11/04 | 281/38 |
| 3,620,552 | A * | 11/1971 | Woodcock | G09B 29/00 | 281/16 |
| 3,913,740 | A * | 10/1975 | Bisberg | G03B 21/132 | 281/3.1 |
| 4,129,914 | A * | 12/1978 | Jahn | B42C 7/00 | 412/17 |
| 4,606,554 | A * | 8/1986 | Lederman | B42F 11/00 | 273/284 |
| 5,921,579 | A * | 7/1999 | Sadler | B42D 3/18 | 283/107 |
| 6,712,396 | B2 * | 3/2004 | Derraugh | B42D 1/003 | 281/38 |
| 2003/0210948 | A1 * | 11/2003 | James, Jr. | B42D 1/001 | 402/57 |
| 2006/0285914 | A1 * | 12/2006 | Bassford | B42D 5/006 | 402/79 |

FOREIGN PATENT DOCUMENTS

| | | | | |
|---|---|---|---|---|
| KR | 200449409 Y1 * | 7/2010 | | |
| WO | WO-2011081916 A2 * | 7/2011 | | B42D 1/001 |

* cited by examiner

*Primary Examiner* — Kyle R Grabowski

(57) ABSTRACT

A book workstation includes a left cover and a right cover, a center spine, and pages sequentially arranged and bound to the center spine. The workbook includes at least one of: a) a left-side underlay and a left-side overlay, each bound to the left-side cover via a left-side spine, or b) a right-side underlay and a right-side overlay, each bound to the right-side cover via a right-side spine. In an open position, the pages can be split into left and right stacks. Indicia on a top page of the left stack are equivalent to indicia on a top page of the right stack. Relative orientations of the indicia enable each of a pair of users to view the indicia on one of the pages at the same time. Each underlay and overlay can be interleaved between pages of one stack, or placed on the top page of that stack.

14 Claims, 7 Drawing Sheets

BOOK WORKSTATION FOR PAIRED USERS

FIELD OF THE INVENTION

This disclosure relates to a book or booklet-type workstation having paired pages in an open configuration that are simultaneously viewable by paired users, and having one or more overlays and underlays that are bound to the workstation and rotatably movable to top surfaces of one or more of the paired pages.

BACKGROUND

Learning is often effectively accomplished in an interactive manner between paired individuals or "users" (for example, between a teacher and student, or between two students who have formed a study team). Discussion between the paired users can often be aided by text books, study guides and/or other printed materials.

While helpful, printed materials provided as separate copies to the individuals may also distract and disrupt communications and eye contact between the individuals. As a result, it would be beneficial to provide these materials in a form that minimizes disruption and distraction (for example, in a common workbook form that is shared and simultaneously viewed by each of the users). The users might, share the workbook sitting across from one another at a table). In addition, it would be beneficial if the workbook facilitated a direct interaction as part of the learning experience (for example, enabling the users to respond to and annotate content in the workbook). In a multi-user instructcional environment, it would also be beneficial if the workbook could be produced in a format in which the annotations could be erased and the workbook be maintained in a hygenic and cleanable manner.

SUMMARY

By way of example, aspects of the present disclosure are directed to disclose a novel book or booklet-type workstation for use by paired users. In accordance with aspects of the present disclosure, the workbook includes a left-side cover, a right-side cover, a center spine flexibly the left-side cover to the right side cover, and a text block comprising a plurality of pages that are sequentially arranged and rotatably bound to the center spine between the left-side cover and the right-side cover. In addition, the workbook includes at least one of: a) a left-side underlay and a left-side overlay, each rotatably bound to the left-side cover via a left-side spine, or b) a right-side underlay and a right-side overlay, each rotatably bound to the right-side cover via a right-side spine.

In an open position, the plurality of pages in the text block are configurable to be arranged in a left stack positioned adjacent to the left-side cover and a right stack positioned adjacent to the right side cover. A top face of a top page of the left stack includes a set of indicia that is equivalent to a set of indicia on a top face of a top page of the right stack. Viewing orientations of the sets of indicia enable a first one of the paired users of the workbook to view the set of indicia on the top page of the left stack and a second one of the paired users to view the first of indicia on the top page of the right stack at the same time. Each of the at least one left-side underlay and left-side overlay, or right-side underlay and right-side overlay, is configured to be rotatably interleaved between pages of the left stack or right stack, or placed on the top page of the left stack or right stack, respectively.

In accordance with aspects of the disclosure, a viewing orientation in the open position of the first set of indicia on the top face of the top page of the left stack is rotated about 180 degrees from a viewing orientation of the first set of indicia on the top face of the top page of the right stack.

In further accordance with aspects of the present disclosure, a viewing orientation in the open position of the first set of indicia on the top face of the top page of the left stack is substantially the same as a viewing orientation of the first set of indicia on the top face of the top page of the right stack.

In further accordance with aspects of the present disclosure, the at least one left-side underlay or right-side underlay is opaque, and the at least one left-side overlay or right-side overlay is formed from a transparent plastic material.

In further accordance with aspects of the present disclosure, the transparent plastic material is suitable to erasably receive markings applied by a wet-erase or dry-erase pen, and is configured, respectively, to be rotated to form a writing surface on the top page of the left stack or the top page of the right stack, respectively In further accordance with aspects of the present disclosure, the at least one left-side overlay and left-side underlay or at least one right-side overlay and right-side underlay are configured, respectively, to be rotated together and in contact with one another to form a white hoard on the top page of the left stack or the top page of the right stack, respectively.

In further accordance with aspects of the present disclosure, one or more of the left-side cover and the right-side cover comprises a cover page having a plastic overlay on one or more of a bottom surface and top surface of the cover page.

This SUMMARY is provided to briefly identify some aspects of the present disclosure that are further described below in the DESCRIPTION. This SUMMARY is not intended to identify key or essential features of the present disclosure nor is it intended to limit the scope of any claims.

BRIEF DESCRIPTION OF THE DRAWING

A more complete understanding of the present disclosure may be realized by reference to the accompanying drawing in which.

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements later developed that perform the same function, regardless of structure.

Unless otherwise explicitly specified herein, the drawings are not drawn to scale.

Figure 1:
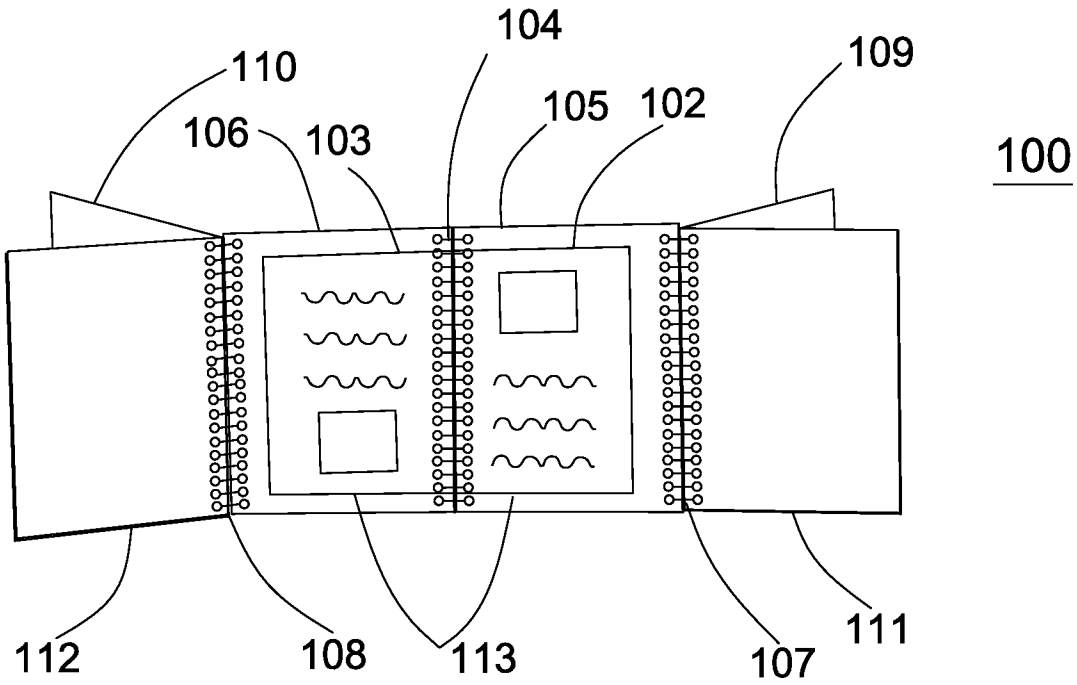
FIG. 1 presents a schematic drawing illustrating a perspective view of an exemplary book or booklet type workstation for paired users in accordance with aspects of the present disclosure.

Aspects of the present disclosure are directed a book or booklet-type workstation that can be simultaneously used by paired users, for example, to facilitate an instructional learning experience between a teacher and student. An exemplary workstation 100 for paired users is depicted in FIG. 1. The workstation 100 as shown includes a left-side cover 106 and a right-side cover 105. A center spine 104 flexibly joins a right-side edge of the left-side cover 106 to a left-side edge of the right side cover 105. The spine 104 may for example comprise a variety of structure types permitting flexible rotating movement of the covers 105, 106, such as a spirals, combs, rings, twin wires, double loops, or the like.

Figure 2:
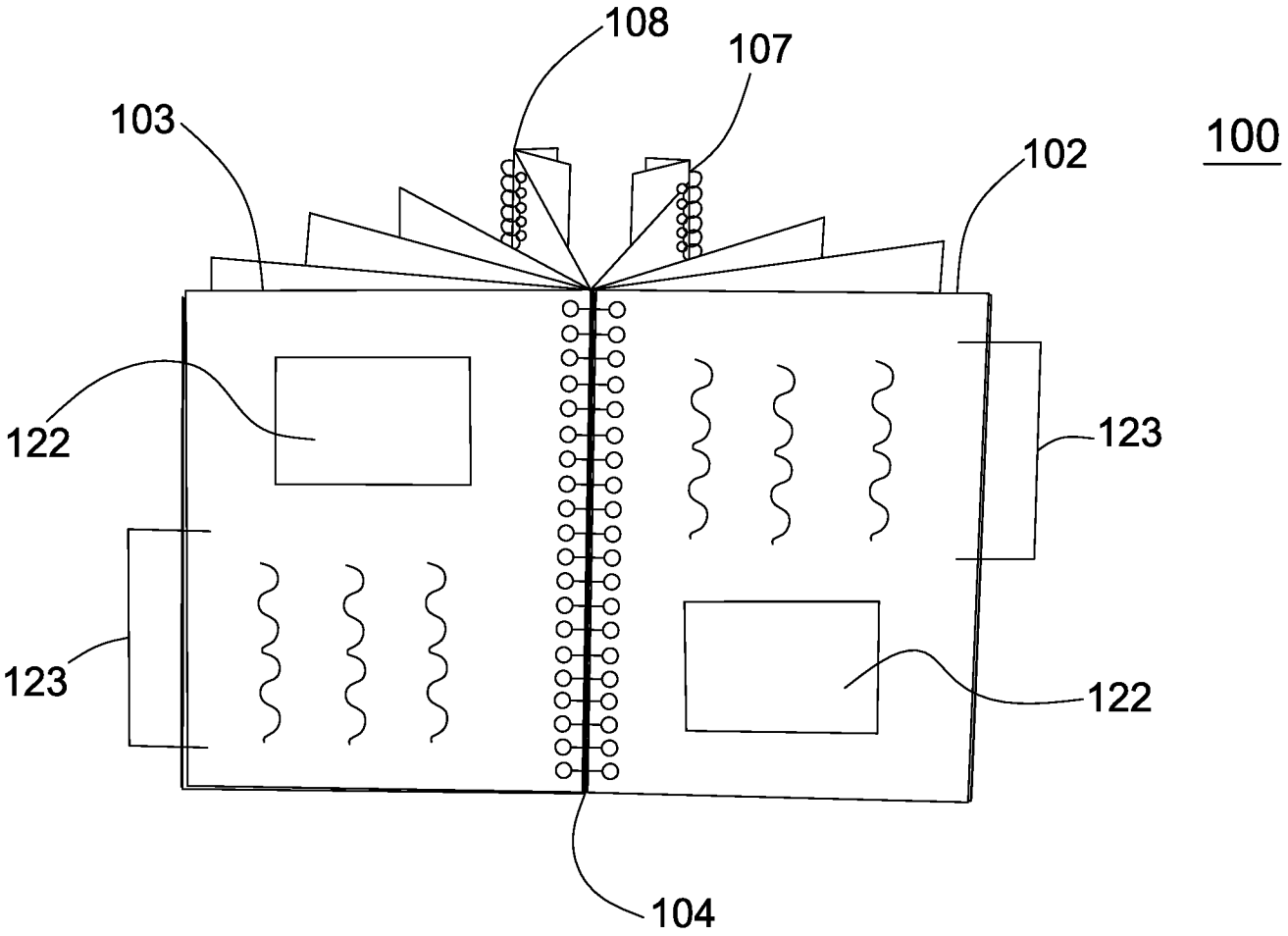
FIG. 2 presents a schematic drawing illustrating a portion of the workstation of FIG. 1.

A text block 113 comprising a plurality of pages (for example, including left-side page 103 and right-side page 102) that are sequentially arranged in the text block 113 and flexibly bound to the center spine 104 between the left-side cover 106 and the right-side cover 105. With reference to FIG. 2, by way of example, a rear face of page 103 and front page of subsequent page 102 each comprise an equivalent set of indicia including an image portion 122 and a text portion 103. In accordance with the present disclosure, a viewing orientation of set of indicia on the rear face of page 103 is rotated about 180 degrees from a viewing orientation of the set of indicia on the front face of subsequent page 102. Significantly, this orientation enables a first one of the paired users to view the content of page 103 and a second one of the paired users to view the content of the subsequent page 102 from opposing positions adjacent to the workstation 100, thereby enabling a convenient paired use of the workstation 100.

For example, as shown in FIG. 2, the first one of the paired users may perceptively view the content of page 103 from a position in proximity to a right edge of the workstation 100, while the second one of the paired users views the identical content of subsequent page 102 from a position in proximity to a left edge of the book. As a second alternative, and as illustrated in FIG. 1, the first one of the paired users may view the content of page 103 from a position in proximity to a top edge of the workstation 100, while the second one of the paired users views the identical content of subsequent page 102 from a position in proximity to a bottom edge of the book. As a third alternative, not shown, the pages 102, 103 may each share a common, side-by-side orientation providing a side-by-side viewing orientation enabling the paired users to sit adjacently to one another along the bottom edge of the book, or alternatively enabling a single user to sit adjacent to the bottom edge, for example, to annotate one of the side-by-side pages 102, 103 for comparison to an un-annotated, other one of the pages 102, 103. The side-by-side orientation page orientation may more easily enable a comfortable learning experience, for example, for a parent-child user pair positioned with the child sitting in the parent's lap. A number of other alternate page orientations are also possible, and contemplated as aspects of the present disclosure.

This configuration may be particularly advantageous, for example, for a learning experience in which the paired users are acting as student and teacher. In this case, the workstation 100 may for example be placed in a horizontal, flat, open position on a table top, with the student and teacher sitting near opposing sides of the table top. In this configuration, the student and teacher are able to face and see each other, while simultaneously being able to perceptively view the identical content of one page 103 or subsequent page 102. In this case, for example, student or teacher may be able to read from or otherwise reference content on one of the pages 103, 102 While the other user follows along on the other page.

Returning to FIG. 1, one or more of the left-side cover 106 or the right-side cover 105 may include an additional spine 108, 107. As depicted, additional spine 108 is bound to a left edge of the left-side cover 106, and further binds the left-side cover 106 to a left-side overlay 110 and left-side underlay 112. Similarly, additional spine 107 is bound to a right edge of the right-side cover 105, and further binds the right-side cover 105 to a right-side overlay 109 and right-side underlay 111. Like center spine 104, additional spines 107, 108 may comprise a variety of structural types such as a spirals, combs, rings, twin wires, double loops, or the like. It will be further understood that, consistent with aspects of the present disclosure, a single underlay or overlay may alternatively be joined to one or more of the additional spines 107, 108, or additional overlay or underlay elements to the overlays 109, 110 and underlays 111, 112 may alternatively be joined to the additional spines 107, 108.

Left-side cover 106 and right-side cover 105 may comprise a stiffened but flexible opaque material (for example, an 80 lb card stock). In addition, left-side cover 106 and right-side cover 105 may preferably be covered on one or both of a top face and a bottom thee with a flexible plastic transparent material (for example, comprising a polypropylene or polyester-based film) that is joined to the center spine and one of the additional spines. In addition or alternatively, the flexible plastic transparent material may be adhered to one of the faces of the covers. These plastic coverings, for example, may provide protection to the covers and enable the workbook to be more easily disinfected and/or cleaned.

Figure 3:
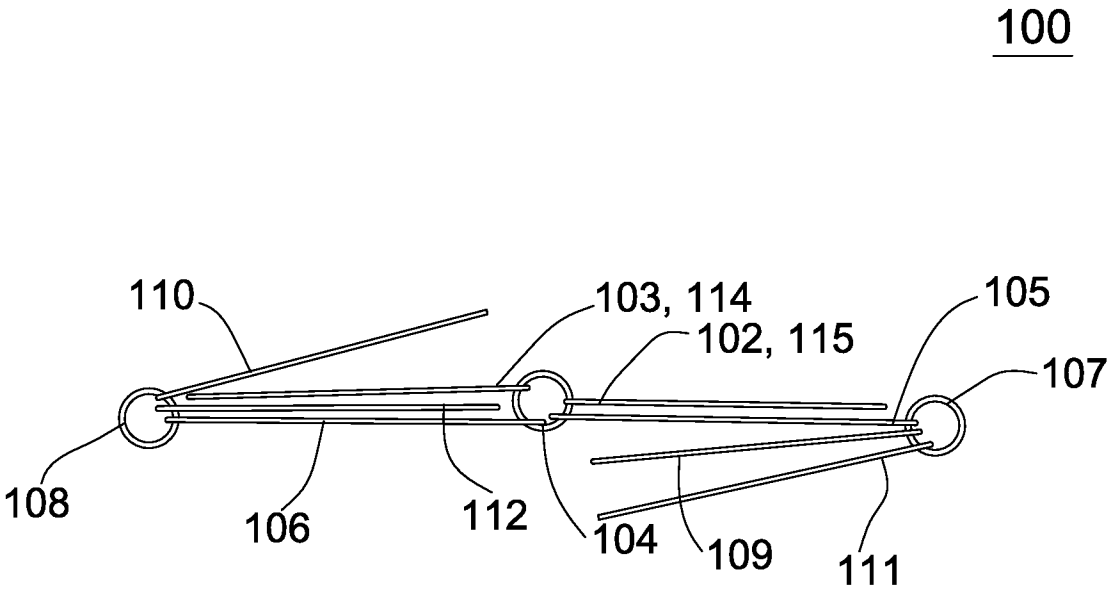
FIG. 3 presents a schematic drawing illustrating a bottom-side view of the workstation of FIG. 1 in a first open position having a flat orientation, in accordance with aspects of the present disclosure.

FIGS. 3-6 illustrate examples of a variety of configurations of the workstation 100. In accordance with aspects of the present disclosure. FIG. 3 presents a schematic drawing illustrating a bottom view of the workstation 100, in a horizontal, flat, open position suitable for placement on a table top, including left-side page 103 and right-side page 102. While left-side page 103 and right-side page 102 are shown in FIGS. 3-6 as singular pages for purpose of clarity, it should be understood that the workstation 100 may comprise additional pages forming the text block 113 of workstation 100. In the open position illustrated for example by FIG. 3, text block 113 may comprise a left stack 114 positioned adjacent to the left-side cover 106, and a right stack 115 positioned adjacent to the right side cover 105.

In the workstation 100 illustrated in FIG. 3, left-side underlay 112 is positioned beneath left-side page 103, and left-side overlay 110 is positioned above left-side page 103. Left-side overlay 110 may preferably comprise a flexible plastic transparent material (for example, comprising a polypropylene or polyester-based film) which is suitable for erasable marking by a dry erase or wet erase marker. In this manner, for example, the overlay 110 may provide a student user with the ability to interact with the content on left-side page 103 in response to a teacher instruction, or alternatively enable the teacher to add to the content of left-sick page 103 for instructional purposes. Left-side underlay 112 may for example comprise a stiffened but flexible opaque material (for example, an 80 lb card stock) to serve as a page marker, and or as a writing support or white board when positioned in combined contact with left-side overlay 110. With reference to right-side cover 105 as depicted in FIG. 3, both right-side underlay 111 and right-side overlay 109 are shown in an alternate stowed position under the right-side cover 105.

Figure 4A:
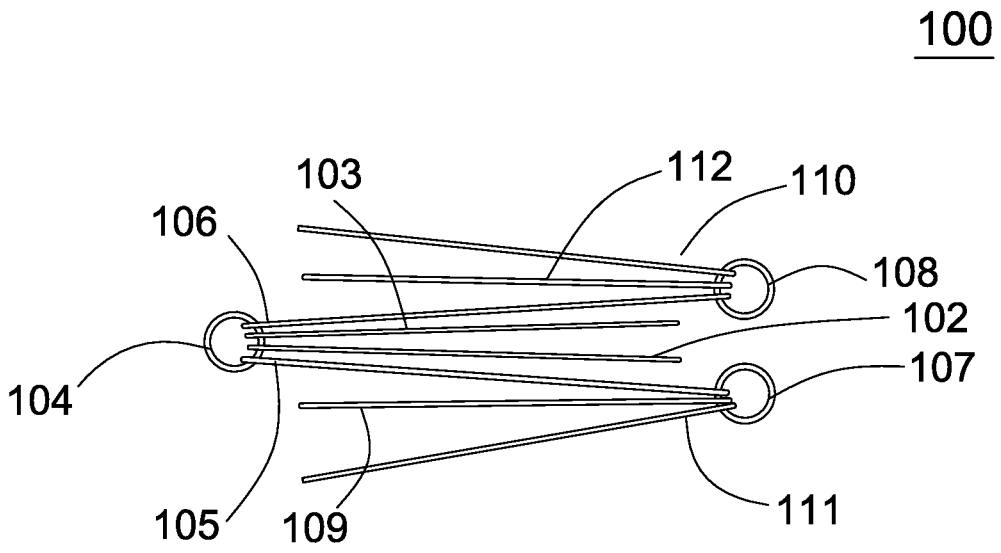
FIG. 4A presents a schematic drawing illustrating a bottom-side view of the workstation of FIG. 1 in a first closed position, in accordance with aspects of the present disclosure.
Figure 4B:
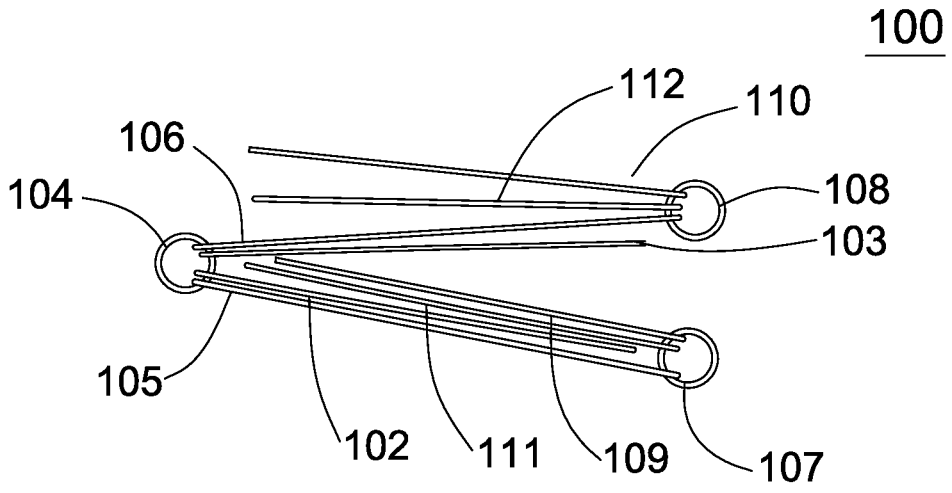
FIG. 4B presents a schematic drawing illustrating a bottom-side view of the workstation of FIG. 1 in a second closed position, in accordance with aspects of the present disclosure.

Exemplary closed configurations of the workstation 100 are illustrated in FIGS. 4A, 4B. In FIG. 4A, each of the underlays 111, 112 and overlays 109, 110 are shown in stowed positions either above left-side cover 106 or beneath right-side cover 105. Optionally, and not illustrated in FIG. 4A, the workstation 100 may include retainer clips or other retention members for retaining the overlays 109, 110 and underlays 111, 112 against the covers 106, 105 in the stowed position. In FIG. 4B, right-side overlay 109 and right-side underlay 111 have been moved from their stowed positions and inserted between left-side page 103 and right-side page 102 to function as a place marker while workstation 100 is in the closed configuration.

Figure 5:
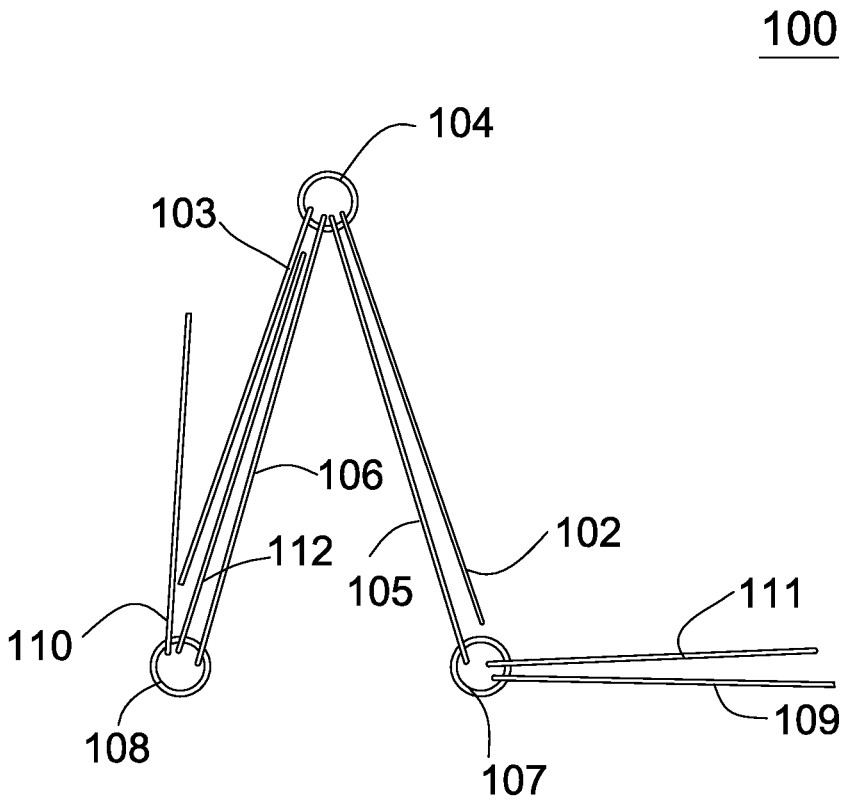
FIG. 5 presents a schematic drawing illustrating a bottom-side view of the workstation of FIG. 1 in a second open position having a raised orientation, in accordance with aspects of the present disclosure.
Figure 6:
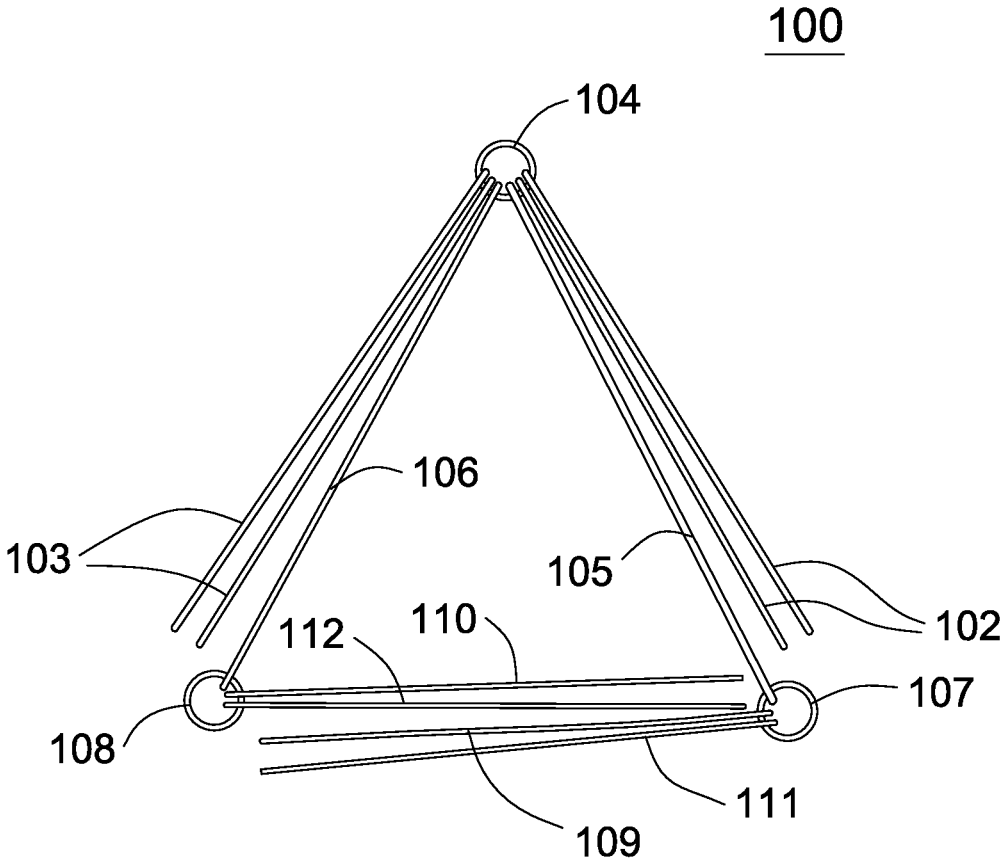
FIG. 6 presents a schematic drawing illustrating a bottom-side view of the workstation of FIG. 1 in a third open position having a raised orientation in accordance with aspects of the present disclosure.

In accordance with additional aspects of the present disclosures, FIGS. 5 and 6 illustrate configurations of the workstation 100 in which left-side cover 106 and right-side cover 105 are opened from a closed position to a reflex angle between 180 degrees and 360 degrees (for example, between 270 degrees and 320 degrees) that is suitable for placing the workstation 100 on a table top, with covers 105, 106 extending upwardly toward center spine 104 in a raised ("tent-fold") configuration. In an alternative configuration not shown, the tent-fold workstation configuration shown in FIGS. 5, 6 can be positioned, for example, such that the spines 104, 107 and 108 extend upwardly perpendicularly from the table top. This positioning is particularly useful when pages 102, 103 ahare a common, side-by-side portrait orientation as described above.

As with the configuration of FIG. 3, the paired users sitting near opposing sides of the table top to view the workstation 100 of FIG. 5 are able to face and see each other, while simultaneously being able to view the equivalent content of page 103 or page 102, respectively. In comparison to the configuration of FIG. 3, the configuration of FIG. 5 enables the paired users to provide less eye movement to view the pages 103, 102 and each other than is required for the open workstation configuration of FIG. 3. In addition, the workstation 100 of FIG. 5 can, for example, be used with a camera together or in place of one of the paired users (for example, a laptop video camera with output accessbile to a plurality of users participating in a video call).

As depicted in FIG. 5, left-side underlay 112 page is positioned beneath left-side page 103, and left side overlay 110 is positioned above left-side page 103 (for example, in position for marking in the case that left-side overlay 110 comprises a flexible plastic transparent material). Right-side overlay 109 and right-side underlay 111 as depicted are positioned in a lateral configuration extending laterally away from the right-side spine 107 in a direction aligned with the table top. In this position, right-side overlay 109 and right-side underlay 111 can easily be moved to positions in proximity to right-side page 102, or remain in the laterally-extending position to provide some stability for example in positioning the workbook 100 on a table top. Alternatively, and not shown, the illustrated configurations of right-side overlay 109 and right-side underlay 111 can alternatively be exchanged, such that right-side overlay 109 is positioned on right-side spine between right-side cover 105 and right-side underlay 111, enabling right-side overlay 109 to be moved to overlay right-side page 102 while right-side underlay 111 remains in the laterally-extending position to provide workstation stability.

In accordance with further aspects of the present disclosure, FIG. 6 depicts another exemplary open configuration of the workstation 100 with left-side cover 106 and right-side cover 105 postioned at a reflex angle to one another. In this illustrated configuration, overlays 109, 110 and underlays 111, 112 are positioned to extend laterally inwardly from the hinges 108, 107 to form a boxlike structure in combination with covers 106, 105, thereby lending tabletop stability to the workstation 100. As described with reference to FIG. 5, and not shown, the configurations of the paired underlays and overlays can alternatively be exchanged so that overlays 109, 110 may extend laterally away from the workstation 100 while underlays 109, 110 extend laterally inwardly with respect to the workstation 100, thereby remaining available to be rotably re-positioned to overlay pages 103, 102 respectively. It should be noted that many other additions and adaptations to the illustrated underlay and overlay configurations (for example, relating to the numbers and positions of such elements) are contemplated aspects of the present disclosure.

Figure 7:
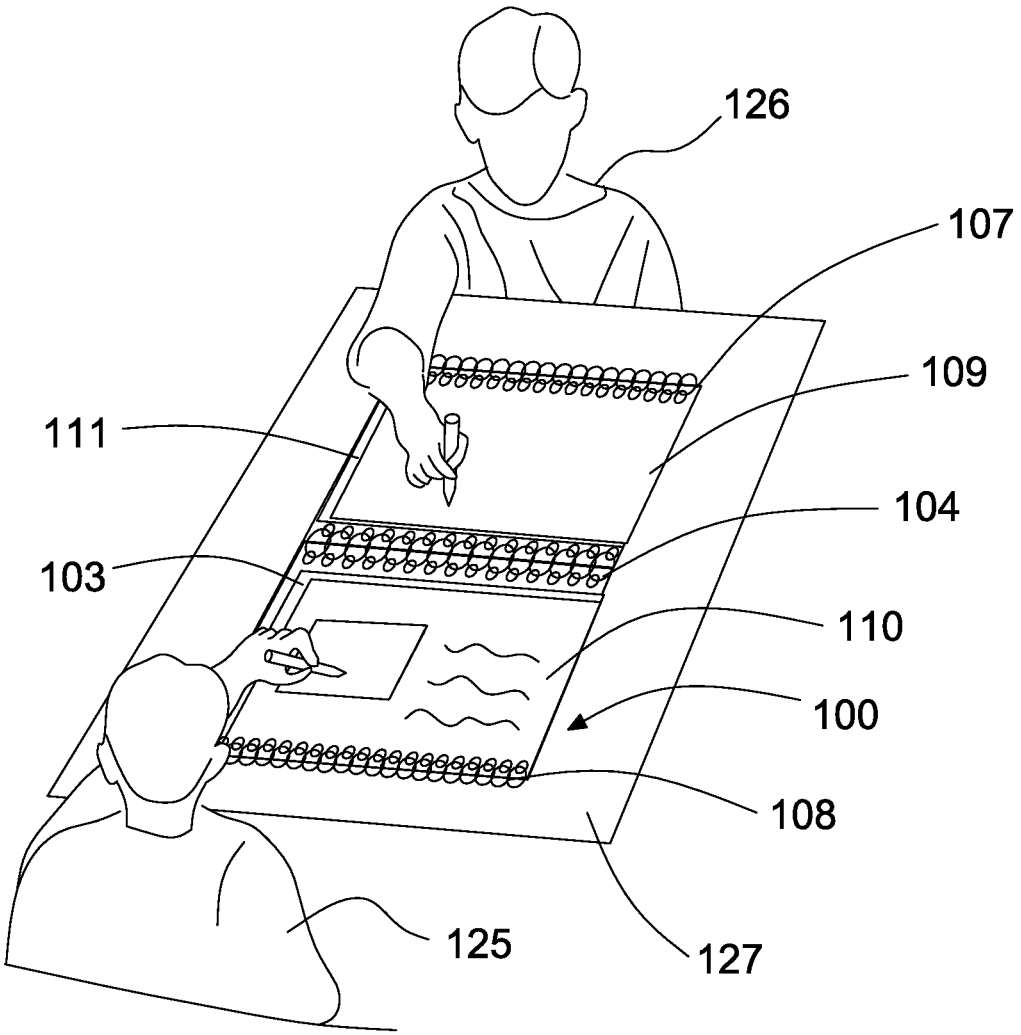
FIG. 7 presents a schematic drawing illustrating a perspective view of the workstation of FIG. 1 in use by first and second users.

FIG. 7 provides a schematic drawing illustrating an exemplary use of the workbook 100 by a first user 125 and second user 126. As shown in FIG. 7, the workbook 100 is positioned on a rectangular work surface 127 (for example, a table top) around which the users 125, 126 are positioned at opposing ends. The workbook 100 is configured in a horizontal, open position, with first user 125 positioned in proximity to left-side spine 108 and second user 126 positioned in proximity to right-side spine 107. As illustrated, transparent left-side overlay 110 is positioned directly over the top face left-side page 103, enabling first user 125 (for example, by means of a wet-erase or dry-erase pen) effectively annotate the content on the top face of left-side page 103 in an erasable manner. Right-side overlay 109 is positioned on top of right-side underlay 111 to cover right-side page 102 (not shown). In this position, the second user 126 is able to apply a wet-erase or dry-erase pen to the combined right-side overlay/underlay 109, 111, which effectively operates as a white board.

It will be understood that, while various aspects of the present disclosure have been. illustrated and described by way of example, the invention claimed herein is not limited thereto, but may be otherwise variously embodied within the scope of the following claims.

The following table lists the reference characters and names of features and elements used herein: Reference characters assigned to method steps are not listed.

| Rel. char. | Feature or element |
|---|---|
| 100 | Book Workstation |
| 102 | Right-side page |
| 103 | Left-side page |
| 104 | Center spine |
| 105 | Right-side cover |
| 106 | Left-side cover |
| 107 | Right-side spine |
| 108 | Left-side spine |
| 109 | Right-side overlay |
| 110 | Left-side overlay |
| 111 | Right-side underlay |
| 112 | Left-side underlay |
| 113 | Text block |
| 114 | Left stack |
| 115 | Right stack |
| 122 | Page indicia, image portion |
| 123 | Page indicia, text portion |
| 125 | First user |
| 126 | Second user |
| 127 | Work surface |

I claim:

1. A workbook for simultaneous use by paired users, comprising:

a left-side cover;

a right-side cover;

a center spine flexibly binding a right-side edge of the left-side cover to a left-side edge of the right side cover;

a text block comprising a plurality of pages that are sequentially arranged and rotatably bound to the center spine between the left-side cover and the right-side cover; and at least one of:

a left-side underlay and a left-side overlay, each rotatably bound to the left-side cover via a left-side spine, or a right-side underlay and a right-side overlay, each rotatably bound to the right-side cover via a right-side spine, wherein, in an open position, the plurality of pages in the text block are configurable in a split arrangement including a left stack positioned adjacent to the left-side cover and a right stack positioned adjacent to the right side cover, wherein a top face of a top page of the left stack includes a set of indicia that is equivalent to a set of indicia on a top face of a top page of the right stack, wherein, in the open position, viewing orientations of the sets of indicia enable a first one of the paired users to view the set of indicia on the top page of the left stack and a second one of the paired users to view the first of indicia on the top page of the right stack at the same time, wherein each of the at least one left-side underlay and left-side overlay, or right-side underlay and right-side overlay, is configured to be rotatably interleaved between pages of the left stack or right stack, or placed on the top page of the left stack or right stack, respectively, wherein the at least one left-side underlay or right-side underlay is opaque, and wherein the at least one left-side overlay or right-side overlay comprises a transparent plastic material that is suitable to erasably receive markings applied by a wet-erase or dry-erase pen, and is configured, respectively, to be rotated to form a writing surface on the top page of the left stack or the top page of the right stack, respectively.

2. The workbook of claim 1, the left-side cover and the right-side cover are configured to be positioned about 180 degrees apart in the open position.

3. The workbook of claim 1, wherein the left-side cover and the right-side cover are configured to be positioned at a reflex angle in the open position.

4. The workbook of claim 1, wherein the center spine comprises one of a spiral ring or a plurality of parallel rings.

5. The workbook of claim 4, wherein the center spine comprises the plurality of parallel rings and includes one of circular rings or oval rings.

6. The workbook of claim 1, wherein a viewing orientation in the open position of the first set of indicia on the top face of the top page of the left stack is rotated about 180 degrees from a viewing orientation of the first set of indicia on the top face of the top page of the right stack.

7. The workbook of claim 6, wherein the opposing positions of the first and second paired users are proximate to a top edge of the workbook and a bottom edge of the workbook, respectively.

8. The workbook of claim 6, wherein the opposing positions of the first and second paired users are proximate to a left-side edge of the workbook and a right-side edge of the workbook, respectively.

9. The workbook of claim 1, wherein a viewing orientation in the open position of the first set of indicia on the top face of the top page of the left stack is substantially the same as a viewing orientation of the first set of indicia on the top face of the top page of the right stack.

10. The workbook of claim 1, wherein the at least one left-side overlay and left-side underlay or at least one right-side overlay and right-side underlay are configured, respectively, to be rotated together and in contact with one another for placement on the top page of the left stack or the top page of the right stack, respectively.

11. The workbook of claim 1, wherein the left-side cover comprises a left-side cover page with a plastic overlay on a bottom surface of the left-side cover page.

12. The workbook of claim 11, wherein the left-side cover further comprises a plastic overlay on a top surface of the left-side cover page.

13. The workbook of claim 1, wherein the right-side cover comprises a right-side cover page with a plastic overlay on a bottom surface of the right-side cover page.

14. The workbook of claim 13, wherein the right-side cover further comprises a plastic overlay on a top surface of the right-side cover page.

* * * * *